US007367146B2

(12) United States Patent
Lopez

(10) Patent No.: US 7,367,146 B2
(45) Date of Patent: May 6, 2008

(54) LIQUID IN MOTION ADVERTISING SIGN

(76) Inventor: Carlos A. Lopez, 1201 Brickell Ave., Miami, FL (US) 33131

( * ) Notice: Subject to any disclaimer, the term of this patent is extended or adjusted under 35 U.S.C. 154(b) by 0 days.

(21) Appl. No.: 11/713,177

(22) Filed: Mar. 2, 2007

(65) Prior Publication Data

US 2007/0209248 A1 Sep. 13, 2007

Related U.S. Application Data

(60) Provisional application No. 60/778,879, filed on Mar. 3, 2006.

(51) Int. Cl.
*G09F 19/00* (2006.01)

(52) U.S. Cl. ..... 40/406; 40/427; 40/409; 40/410; 239/16; 239/17; 239/18; 239/19; 239/20; 239/211; 446/237

(58) Field of Classification Search ..... 40/406, 40/409, 410; 239/16–20, 211; 446/267
See application file for complete search history.

(56) References Cited

U.S. PATENT DOCUMENTS 5,167,993 A * 12/1992 Aoyagi ..... 428/34
6,119,382 A * 9/2000 Hakkert ..... 40/406
6,695,222 B1 * 2/2004 Lin ..... 239/17

* cited by examiner

*Primary Examiner*—Lesley D. Morris
*Assistant Examiner*—Shin Kim
(74) *Attorney, Agent, or Firm*—Alberto A. Leon, Esq.; Bauman, Dow & Leon P.C.

(57) ABSTRACT

The present invention represents a breakthrough in advertisement tools. The liquid sign uses a system of chambers and electrically powered pumps to produce a dynamic and visually appealing advertising sign. The advertising sign of the invention uses a liquid in motion contained in a front chamber of the sign to highlight the color and other visual characteristics of a beverage or any liquid product being advertised. The liquid in motion highlights and showcases any given characteristic of a product being advertised, including bubble or foam producing capacity, color, brightness, or a logo or symbol placed on the background of the liquid in motion. It also provides for a visually attractive, electrically or battery powered and affordable advertising tool which can be used indoors or outdoors in many different settings.

4 Claims, 5 Drawing Sheets

LIQUID IN MOTION ADVERTISING SIGN

CROSS-REFERENCE TO RELATED APPLICATION

I hereby claim the benefit under Title 35, United States Code Section 119(e) of any United States Provisional Application(s) listed below:

Application No. 60/778,879

Filing Date: Mar. 3, 2006

BACKGROUND OF THE INVENTION

1. Technical Field of the Invention

This invention relates generally to advertising signs, more particularly, but not by way of limitation, to an advertising sign which features a liquid in motion, generally representing the beverage being advertised.

2. Description of the Background Art

Advertising has been a way of life in American society almost from the inception of our country. Electrically powered advertising signs are almost as old as any other electrically powered device. Thomas Edison invented the modern incandescent lamp in 1879. By 1892, the well-known Manhattan Beach electric sign had been lit in New York City. The commercial and patent literature discloses thousands of different references about all kinds of signs and sign technology being used in advertising activities. Applicant was unable to find any prior art patent which discloses or claims a liquid in motion, imitating the visual characteristics of a beverage being advertised, as part of the visible element of an advertising sign.

SUMMARY OF THE INVENTION

An objective of the present invention is to provide for a dynamic, visually appealing advertising sign which uses a liquid in motion contained in a front chamber of the sign to highlight the color and other visual characteristics of a beverage being advertised.

Another objective of the present invention is to utilize a liquid in motion to highlight or showcase any given characteristic of a product being advertised, including color, a logo or symbol placed on the background of the liquid in motion.

Still another objective of the present invention is to provide for a visually attractive, electrically powered and affordable advertising tool which can be used indoors or outdoors in many different settings.

The advertising sign of the present invention comprises a housing which in turn comprises two chambers, a front chamber and a back chamber, and a dividing means. The housing element comprises a front side and a back side. The back chamber, which can be accessed from the back side of the housing, comprises a posterior side and an anterior side. The following elements are engaged to the posterior side: a CCFL switch, a switching power supply, a pump switch, an air pump, a control board, a knob for controlling bubblers, a knob for controlling cycling times and a transformer. The following elements are engaged to the anterior side: two liquid pumps, one suction pump and one wet-pit pump; a unilateralism valve; and a CCFL high voltage control board. The anterior side further comprises an oil tank, and air pipe and an oil pipe. The posterior side further comprises an air out pipe. All electrical components are properly wired to each other and to an electrical supply to provide proper functioning of the advertising sign of this invention. Leak proof elastoplastic rings and screws are used between the chambers to prevent leaking.

The front chamber serves as a tank capable of receiving the liquid in motion and can be fitted with any kind of advertising or promotional logo, lettering, numbering or any other commercial designation. The front chamber is protected by a transparent acrylic cover which allows visual access to the advertisement placed therein. In the preferred embodiment of the invention, the front chamber can be lit using 4 small CCFLs, projecting light over the logo, lettering, numbering or commercial designation being advertised, as well as the liquid in the front chamber.

An alternative embodiment of the invention would use an air pump capable of letting air go through a piece of wood to create the effect of bubbles being pumped into the front chamber as the liquid is being injected. The size of the bubbles can be adjusted and due to the placement of the piece of wood and buoyancy, the bubbles naturally move from the bottom of the front chamber to the top.

The present invention comprises a control circuit to manage the liquid cycling process. An indirect current control circuit controls the timing, working current, working voltage and the liquid cycling effect. The front chamber lighting effect is achieved by means of a high voltage board which allows electricity to be let out and light up fluorescent powder which, in an embodiment of the invention, can be applied to the front chamber's side bearing the advertising being showcased. The control circuit also allows electricity to power the bubbling system.

While cycling liquid, the system of this invention can be calibrated to provide a desired speed of filling the front chamber with liquid and emptying it. The time of emptying the front chamber is calculated based on the volume of the front chamber and the power of the pump. The present invention can pump liquid into the front chamber from top to bottom or from bottom to top. The volume of the back chamber is twice or more than the volume of the front chamber to ensure the liquid can reach the top of the front chamber.

The liquid in the advertising sign recirculates in the following manner: the liquid is stored in the back chamber and is pumped into the front chamber by the wet-pit pump; once the front chamber fills to the desired level, the liquid is drained from the bottom of the front chamber into the back chamber by the suction pump.

PREFERRED EMBODIMENT OF THE INVENTION

Figure 1:
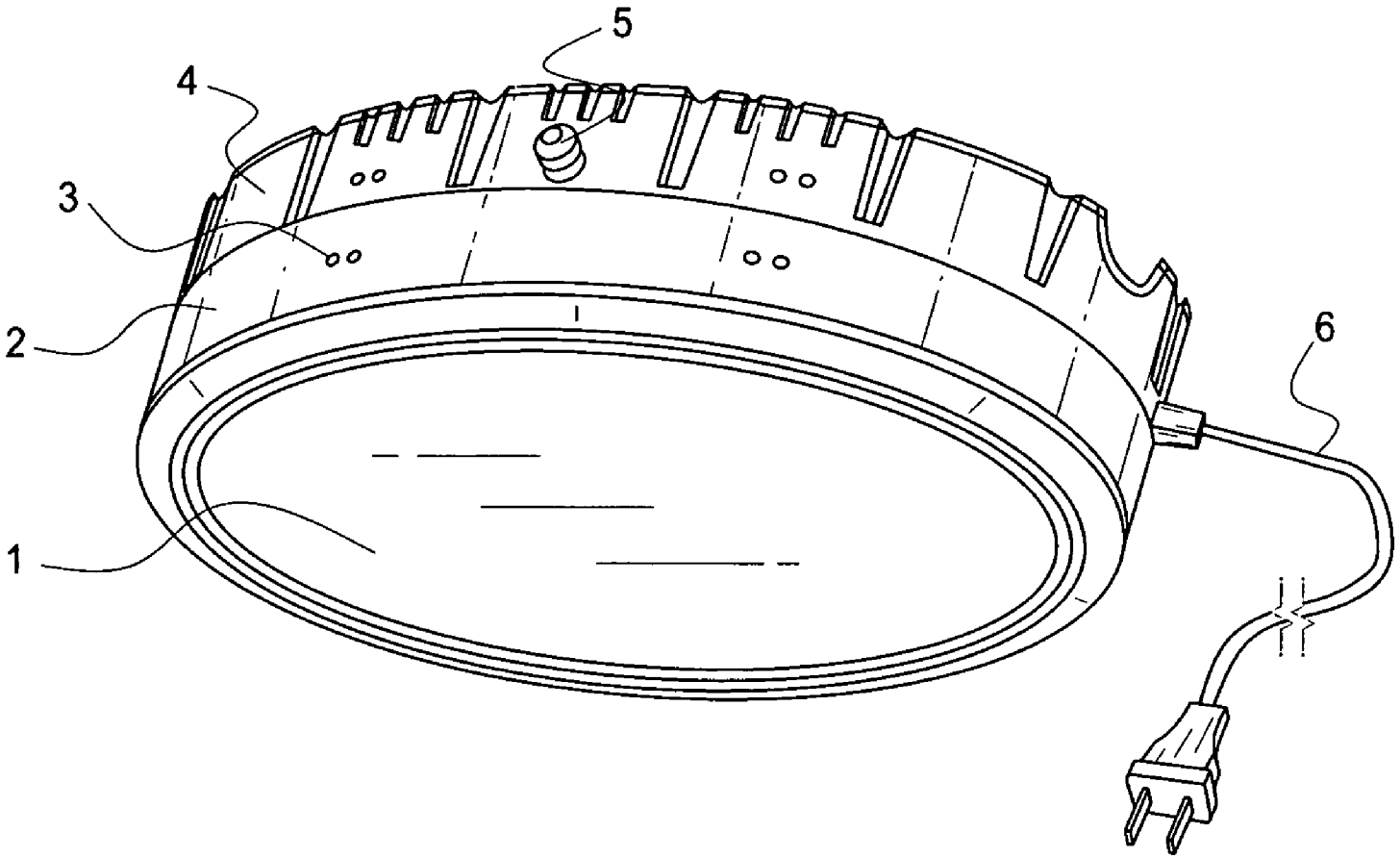
FIG. 1: Shows a Front Perspective View of Assembled Apparatus
Figure 2:
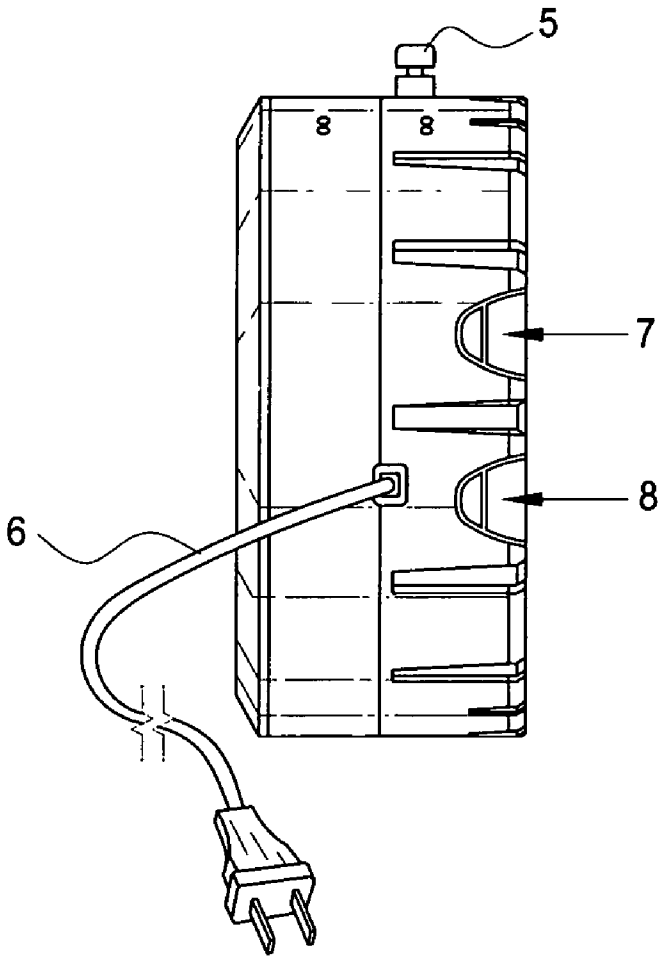
FIG. 2: Shows a Side View of Assembled Apparatus
Figure 3:
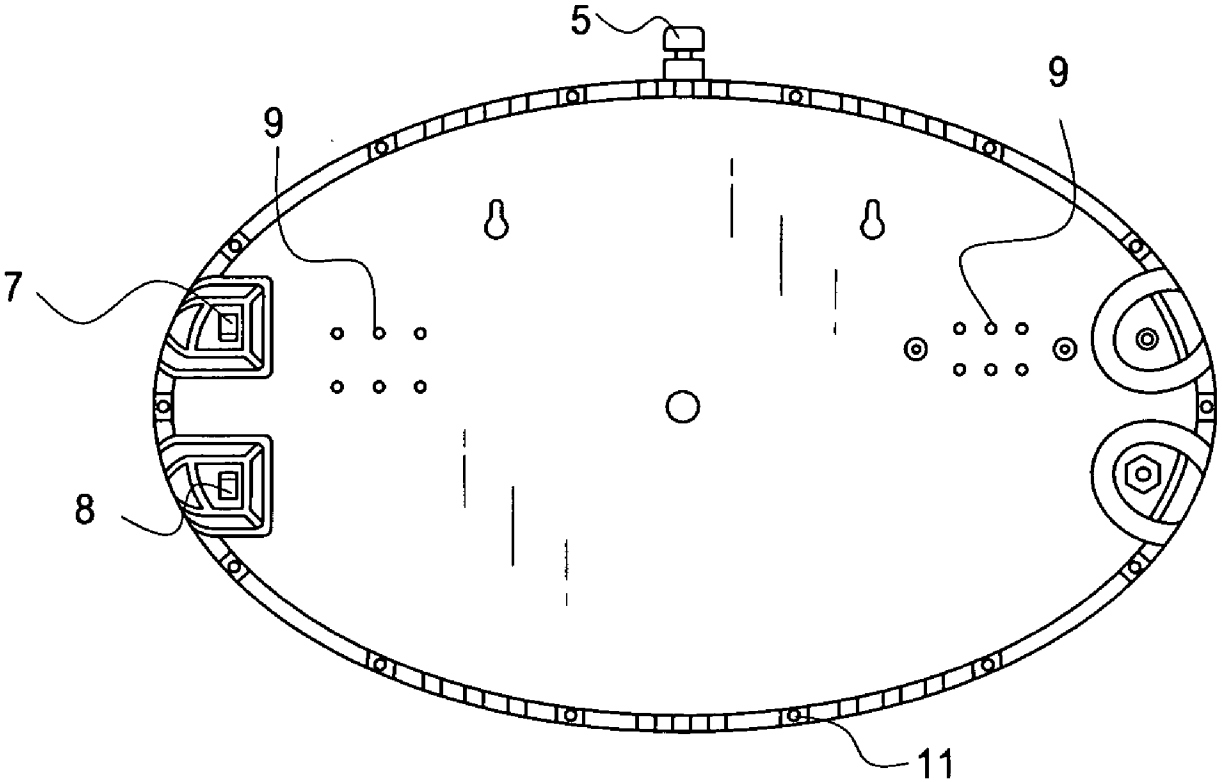
FIG. 3: Shows the Assembled Rear Side View of the Apparatus of the Invention
Figure 4:
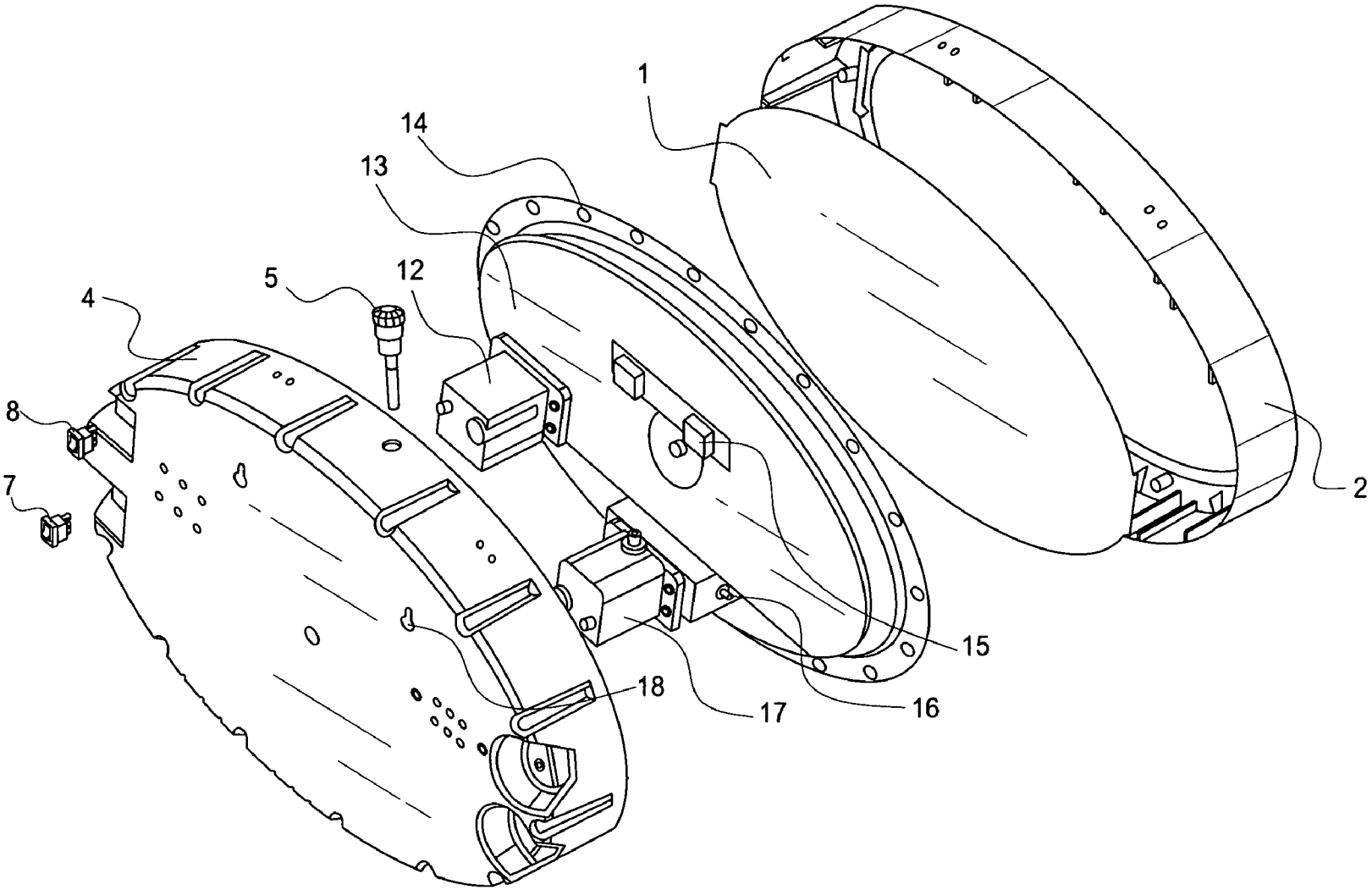
FIG. 4: Shows a Side Perspective View of Partially Disassembled Apparatus from the Rear Side of the Housing
Figure 5:
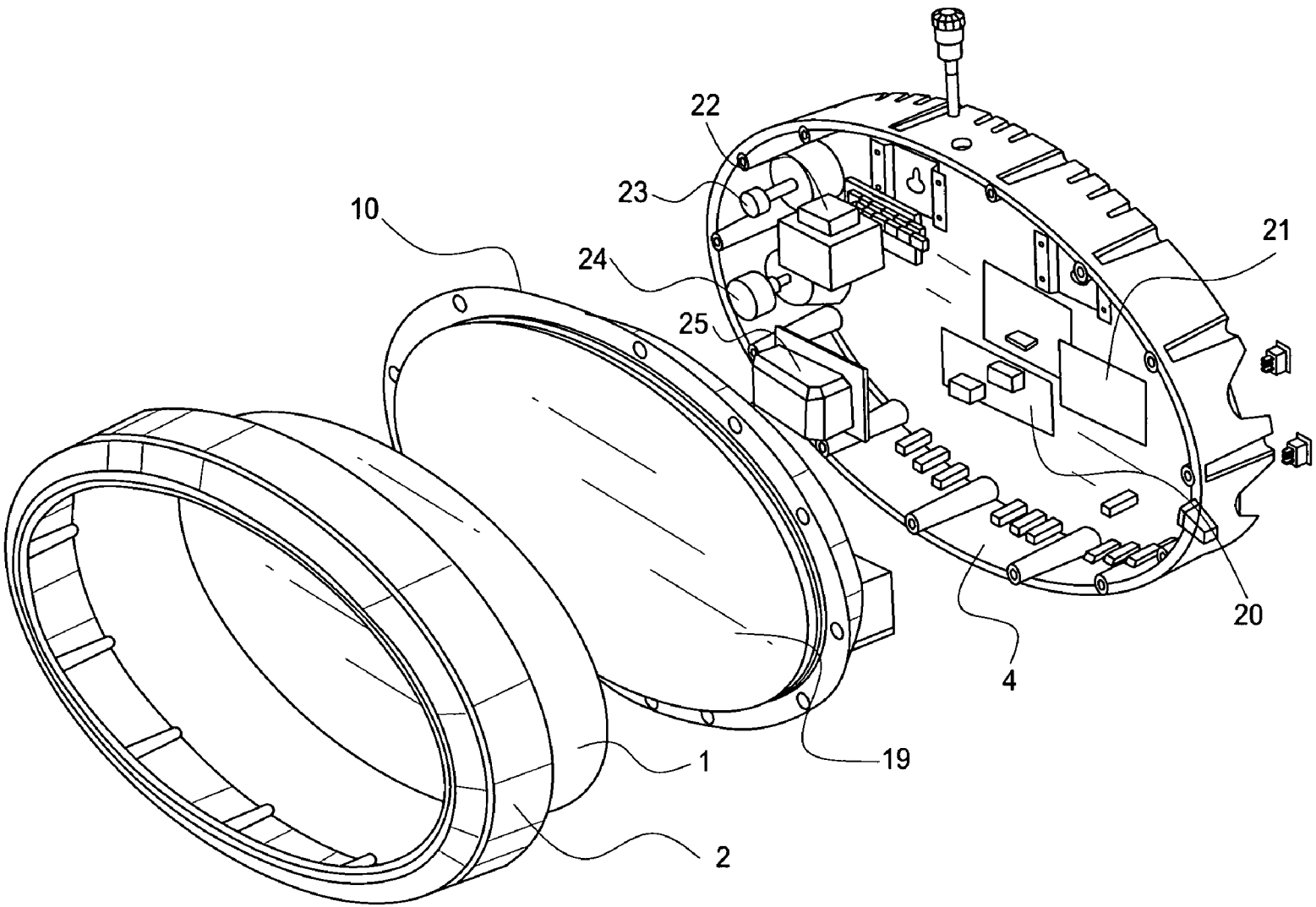
FIG. 5: Shows a Side Perspective View of Partially Disassembled Apparatus from the Front Side of the Housing

The preferred embodiment of the invention is a circular or oval advertising sign for a beverage or other liquid, comprising an advertising logo or symbol with recirculating liquid in the background. The sign comprises a housing and a two-chambered insert which engage the electrical components of the advertising sign, and at least four cold cathode fluorescent lights (CCFL) as a lighting means to illuminate the liquid and the advertisement.

The housing comprises a rear side (4) and a front side (2), the front side being slightly larger in circumference than the rear side, so that it fits over the rear side and screws in place through a plurality of aligned holes (11), giving the advertising sign a finished look. A larger hole in both sides of the housing allows for an electrical supply cord (6) to extend into the housing to power the electrical components of the sign. The front side further comprises hanging means (3) for suspending the advertising sign. The front side of the housing is annular with a large space in the front through which consumers can view the advertisement and circulating liquid. A transparent acrylic sign face (1) holding the printed or three-dimensional advertisement fits up against the opening of the front housing side.

The rear side of the housing comprises an outer side and an inner side, the outer side comprising holes (18) for affixing the advertising sign to a wall and heat radiating openings (9). In the preferred embodiment of the invention, the inner side engages several elements of the electrical system, comprising a power switch for the lighting means (8), a power switch for the three pumps (7), a switching power supply (20), a transformer (22), a control knob (24) for the air pump, a control knob (23) for the cycling time for recirculation of the liquid in the sign, an air pump (25) and a control board (21) for the three pumps. The control board is wired to the three pumps and the two control knobs and is capable of controlling the timing, working current and working voltage of the pumps. The two power switches protrude through openings in the housing, so that they can be accessed without disassembling the housing.

The two-chambered insert comprises a front chamber (19), a rear chamber (13) and a dividing means, each chamber acting as a tank for the recirculating liquid. The back chamber acts as a storage tank during recirculation and holds at least twice the volume of liquid as the front chamber. The two chambers are screwed together through aligned holes (14) to form the insert, and a leak proof elastoplastic ring (10) is placed over the edges of the insert to prevent leaking. A bubbling means is fixedly attached to the bottom of the front chamber. An air pipe extends from the air pump into bottom of the front chamber (16) and attaches to the bubbling means. The air pipe further comprises a unilateralism valve to prevent liquid from entering the air line. An air out control knob (5) extends from the front chamber through both the front and rear sides of the housing, allowing air to escape from the front chamber as it is filled with liquid.

Both chambers have an inner surface and an outer surface, the two inner surfaces facing each other when the insert is assembled. The outer surface of the front chamber is transparent, allowing consumers to see the liquid recirculating within it. The inner surface of the front chamber is opaque, blocking the consumer's view of the back chamber.

The outer surface of the back chamber engages several elements of the electrical system, comprising a CCFL high voltage board (15) for the lighting means, a suction pump (12) and a wet-pit pump (17). The suction pump is attached to two oil pipes; one extending from the bottom of the front chamber to the suction pump, and the other extending from the suction pump to the back chamber. The wet-pit pump is also attached to two oil pipes; one extending from the back chamber to the wet-pit pump, and the other extending from the wet-pit pump to the front chamber. In one embodiment of the invention, the oil pipe from the wet-pit pump enters at the bottom of the front chamber. In another embodiment of the invention, the oil pipe from the wet-pit pump enters at the top of the front chamber, allowing the liquid to spill down into the front chamber.

In the preferred embodiment of the invention, the liquid selected to recirculate through the advertising sign is an appropriate color and thickness to approximate the liquid being advertised, or if the advertisement is not for a liquid, the liquid must be a color and thickness that is appealing to consumers. The liquid must also be an appropriate viscosity to allow the pumps to recirculate the liquid without difficulty.

The invention claimed is:

1. A recirculating liquid advertising sign, comprising:

a. a housing, the housing further comprising an annular front side and a slightly smaller in circumference rear side, so that the rear side fits inside the front side to give the advertising sign a finished look, the front side further comprising a hanging means to suspend the advertising sign from above, and a large opening through which the advertisement and recirculating liquid can be seen, the rear side further comprising an outer side, an inner side, and multiple heat radiating openings, the outer side comprising multiple holes for affixing the advertising sign to a wall, the housing's front side and the rear side further comprising a plurality of holes capable of allowing screws to fasten the front side and rear side together and multiple openings for controls for the advertising sign;

b. a two-chambered insert capable of recirculating liquid, fixedly attached to the front side of the housing element, the insert comprising a transparent front chamber, capable of allowing the contents of the front chamber to be seen through the front of the housing, and a back chamber, wherein the volume of the back chamber is at least twice the volume of the front chamber, the back chamber further comprising an interior and exterior side, the insert further comprising an opaque dividing means between the front chamber and the back chamber, and an edge portion, the edge portion comprising a multitude of aligned holes capable of allowing screws to hold the chambers of the insert and the dividing means together, and a leak proof elastoplastic ring around the edge of the insert to prevent leaking;

c. a lighting means comprising at least four CCFLs capable of illuminating the advertising logo and the recirculating liquid in the front chamber;

d. a CCFL high voltage board fixedly attached to the exterior side of the back chamber and wired to the lighting means;

e. an air pump fixedly attached to the inner side of the back side of the housing element;

f. an air pipe extending from the air pump to a bubbling means fixedly attached to the bottom of the front chamber, the air pipe further comprising a unilateralism valve to prevent liquid from the front chamber from entering the air pipe;

g. a suction pump fixedly attached to the exterior side of the back chamber with an oil pipe leading from bottom of the front chamber through the suction pump to the back chamber, the suction pump being capable of functioning at different rates and at different intervals, allowing for different liquid cycling times;

h. a wet-pit pump fixed attached to the exterior side of the back chamber with an oil pipe leading from the bottom of the back chamber through the wet-pit pump to the front chamber, the wet-pit pump being capable of functioning at different rates and at different intervals, allowing for different liquid cycling times;

i. a transformer fixedly attached to the inner side of the back side of the housing element;

j. a control knob to adjust the cycling time of the suction pump fixedly attached to the inner side of the back side of the housing element;

k. a control knob to adjust the flow of the air pump fixedly attached to the inner side of the back side of the housing element;

l. a control board for the pumps, fixedly attached to the inner side of the back side of the housing element, the control board wired to the pumps, the control knobs and the transformer;

m. a power switch for the lighting means fixedly attached to the inner side of the back side of the housing element which protrudes through an opening in the housing to allow the switch to be activated without disassembling the housing element;

n. a power switch for the pumps fixedly attached to the inner side of the back side of the housing element which protrudes through an opening in the housing to allow the switch to be activated without disassembling the housing element;

o. a switching power supply fixedly attached to the inner side of the back side of the housing element;

p. an air-out control knob which extends from the exterior of the advertising sign, through holes in the front and back housing and into the front chamber of the insert;

q. a transparent acrylic sign face with an printed or three-dimensional advertisement placed between the front side of the housing element and the front chamber of the insert, allowing consumers to see the advertisement and the recirculating liquid behind it through the opening in the front side of the housing element;

r. electrical wiring to properly wire all electrical components to each other;

s. an electrical supply to provide proper functioning of all electrical components; and t. a liquid with appropriate color and density to mimic the liquid being advertised and appropriate viscosity to allow for pumping through the two chambers by the wet-pit pump and the suction pump.

2. A recirculating liquid advertising sign according to claim 1, wherein a fluorescent powder is applied to the transparent acrylic sign face, allowing the face to fluoresce when the lighting means is turned on.

3. A recirculating liquid advertising sign according to claim 1, wherein the wet-pit pump pumps the liquid from the back chamber into top of the front chamber, creating a pouring effect.

4. A recirculating liquid advertising sign according to claim 1, wherein the lighting means comprises multiple light emitting diodes.

* * * * *